United States Patent [19]

Bessaguet

[11] 4,100,701

[45] Jul. 18, 1978

[54] ULTRASONIC MACHINING

[75] Inventor: Louis Pierre Bessaguet, Landouge, France

[73] Assignee: Agence Nationale de Valorisation de la Recherche (ANVAR), France

[21] Appl. No.: 711,444

[22] Filed: Aug. 4, 1976

[30] Foreign Application Priority Data

Aug. 5, 1975 [FR] France ..... 75 24409

[51] Int. Cl.[2] ..... B24B 19/00

[52] U.S. Cl. ..... 51/157; 51/59 SS; 51/281 R

[58] Field of Search ..... 51/157, 59 R, 59 SS, 51/281 R

[56] References Cited

U.S. PATENT DOCUMENTS

| | | | |
|---|---|---|---|
| 2,967,381 | 1/1961 | Brown | 51/59 SS |
| 3,023,547 | 3/1962 | Tesche | 51/59 SS |
| 3,091,060 | 5/1963 | Giegerich | 51/59 SS |
| 3,180,064 | 4/1965 | Ohntrup | 51/59 SS |
| 3,497,930 | 3/1970 | O'Connor | 51/59 R |

*Primary Examiner*—Harold D. Whitehead

*Attorney, Agent, or Firm*—Weingarten, Maxham & Schurgin

[57] ABSTRACT

The invention relates primarily to ultrasonic machining which involves vibrating the part to be machined rather than a tool of the machine. To impart vibrations to the part to be machined it is secured to a metallic part for transmitting vibrations which is in turn connected to a transducer for converting electrical oscillations into mechanical vibrations. An abrasive is supplied to the space between the opposed operative faces of the tool and the part to be machined. The invention also relates to an installation for carrying out the method which includes a machining enclosure and a recycling assembly for recycling the abrasive liquid mixture which is used during the process.

8 Claims, 2 Drawing Figures

ULTRASONIC MACHINING

BACKGROUND OF THE INVENTION

1. Field of the Invention

The present invention relates to machining by means of oscillatory vibrations and, more particularly, to ultrasonic machining for machining the front surface of a work-piece by means of a tool of which the front surface has a contour complementary to that to be reproduced on the work-piece.

The invention is applicable particularly in the field of manufacture of graphite work-pieces such as electrodes intended to be used as tools for machining by electro-erosion or again in the field of manufacture of moulds for injection moulding of synthetic-resins, ceramics or metal alloys.

2. Summary of the Prior Art

Ultrasonic machining is used more particularly for working on materials such as ceramics, calcined or vitrified materials, graphite and so on which cannot readily be machined by other methods, and has been established as particularly advantageous for reproducing complex profiles which could not be obtained by, for example, electro-erosion or by way of electro-chemical techniques because of the nature of the material to be worked.

However, the possibilities of ultrasonic machining are limited at the present time. In fact, in known machines for ultrasonic machining, the mechanical vibrations are transmitted to the tool by a vibrating part rigid with the tool whilst the work-piece is fixed. The maximum power of existing ultrasonic mechanical vibration generators does not permit the use of tools of large size. In particular, the frontal surface of the tool, which has the relief contours to be reproduced, is limited by the maximum permissible value of the section of the vibrating part. As the relief surface reproduced on the work-piece is at a maximum equal to that of the relief contour present in the front face of the tool, it is not possible to use ultrasonic machining apparatus when the work-piece has relatively large dimensions. In this case it is then necessary to resort to conventional machining methods, such as milling, which renders the operation extremely protracted and delicate, particularly when the contour to be reproduced is complex.

It has already been proposed in U.S. Pat. No. 3,465,480 to effect machining of the front face of a work-piece by means of a fixed tool, the work-piece being secured on a plate movable with an oscillatory movement by means of a mechanical transmission system including eccentrics. However, it is clear that such a system will not allow working with ultrasonic frequency with the advantages of precision and speed which it provides.

The present invention has for its object to provide an ultrasonic machining method which enables the manufacture of relatively large parts and of which use of tools which could not, because of their weight and dimensions, be put into motion to ultrasonic frequencies within reasonable times by means of existing mechanical vibration generators.

SUMMARY OF THE INVENTION

According to the present invention there is provided a method of ultrasonic machining a work-piece by means of a tool having one face with a relief contour complementary to the relief contour to be reproduced on an opposed face of the work-piece comprising the steps of mounting the work-piece on a vibratory part by means of a coupling material interposed between a face of the work-piece opposite the face to be machined and a face of the vibratory part, coupling the vibratory part to a transducer for converting electrical oscillations into mechanical vibrations, machining the said face of the work-piece on which the relief contour is to be reproduced by applying mechanical vibrations to the vibratory part and supplying abrasive material to the space between the opposed faces of the tool and the work-piece.

When it is required to produce a part of large dimensions, it is possible to machine separately several blocks or work-pieces for example of standard dimensions, so as to reproduce on at least one part of a face of each block a predetermined relief surface which is to be formed on the part as a whole, the blocks machined being then assembled so as to form the part having on one of its faces the complete profile contour required. This is made possible because, each block being secured to the vibratory part, it is possible to machine the whole of the front face of a block in conformity with the profile of the corresponding tool on condition that the block is located relatively precisely in relation to the vibratory part.

In contrast, this modular fabrication of a part cannot be effected with known machines by ultrasonic machining in which the tool is movable while the work-piece is fixed. In fact, it would then be necessary to machine the whole of the front face of each block in conformity with the profile of the face of the tool overlaying the block, which would be in practice impossible particularly because it would not be possible to provide any guide surface surrounding the surface to be machined of a block and enabling introduction of abrasive under good conditions in the space between the block and the tool. This difficulty would in particular be insurmountable when the profile to be reproduced on the block or other work-piece to be machined is at least in part concave.

The method in accordance with the present invention will be found to be particularly advantageous for the manufacture by ultrasonic machining of parts which must have, on at least one large sized portion of one of their faces, a predetermined relief contour, in particular a complex relief, parts which could not otherwise be machined except by mechanical methods, such as milling. The method in accordance with the invention is far more readily put into practice and enables a considerable time advantage, its advantages being extremely important in the economic plane.

Another advantage of the method in accordance with the invention resides in the fact that the tool, not being subject to a vibratory movement, need not be manufactured of a special material to enable transmission of the ultrasonic frequency waves. The range of materials capable of being used for tools is thus substantially enlarged.

Further according to the present invention there is provided in an ultrasonic machining installation means defining a machining enclosure, a support for a work-piece, means for imposing ultrasonic frequency vibrations on the work-piece including an electrical ultrasonic frequency vibration generator, a vibratory part coupled to this generator and a transducer for converting electrical oscillations into mechanical vibrations, means for driving the work-piece vertically, means for securing a tool on the bottom of the machining enclosure, means defining at least one passage for supplying an abrasive in a liquid vehicle, this passage delivering to the interior of the machining enclosure and being capable of supplying the abrasive/liquid mixture at a level above that of the upper face of the tool, and a recycling assembly for recycling the abrasive/liquid mixture connected to an orifice situated in the bottom of the machining enclosure.

Still further according to the present invention there is provided in an assembly for ultrasonic machining of a work-piece, a tool having a complementary relief contour to that to be reproduced in one face of the work-piece, a vibratory part, a transducer for converting electrical oscillations into mechanical vibrations, and in transmitting relationship with the vibratory part, and a coupling material connecting the face of the work-piece opposite to its first face to a face of the vibratory part opposite to its first face.

Other features and advantages of the invention will be apparent from reading the description, given hereafter by way of indicative, non-limiting example, of a particular method for putting it into practice.

DESCRIPTION OF THE PREFERRED EMBODIMENT

Figure 1:
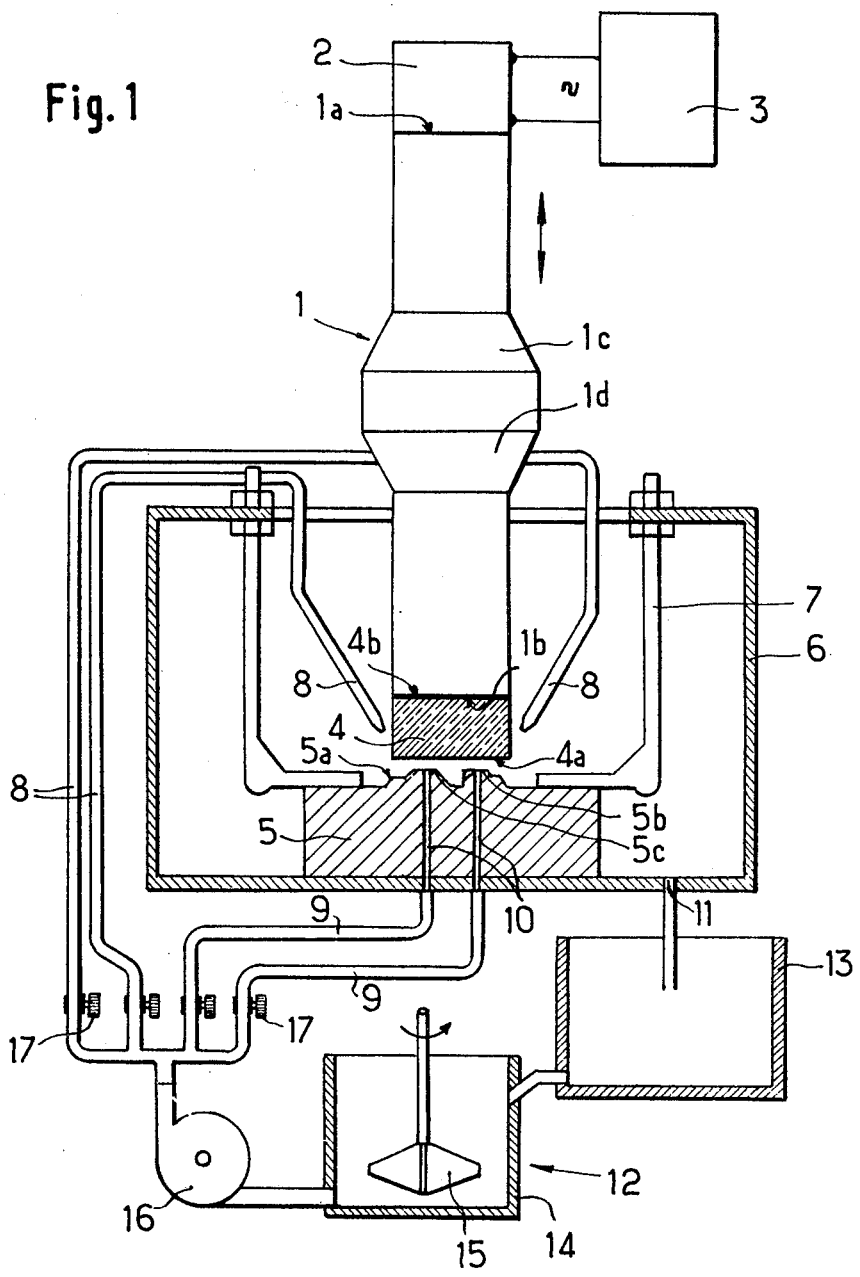
FIG. 1 is a diagrammatic view, partly in section, of an ultrasonic machining installation for carrying out the method in accordance with the invention.

A mechanical vibration generator comprises a vibratory part 1, for example of steel, of titanium or a light alloy, on an upper face 1*a* of which a transducer 2 is secured for converting electrical oscillations into mechanical oscillations, for example, a piezo-electric transducer. The transducer 2 is connected to a power generator 3 supplying electrical impulses at an ultrasonic frequency, for example of the order of 30 kHz.

The vibratory part 1 has an elongate parallelepiped shape and may include 1*c*, 1*d* of enlarged section. The length of the vibratory part 1 as well as the shape and the disposition of the portions 1*c*, 1*d*, are arranged to enable optimum transmission of oscillations by the vibratory part 1.

The mechanical oscillation generator thus has a construction generally similar to those used in previously proposed machines for ultrasonic machining.

The rear face 4*b* of a block 4 or other work-piece to be machined is connected to the lower face 1*b* of the vibratory part, and is, for example, of graphite, and has to be machined so as to reproduce on its front face 4*a* opposite to the face 4*b* a predetermined relief contour. Preferably, the faces 1*b* and 4*b* have the same dimensions in order to avoid creation of a discontinuity which might adversely affect the transmission of the mechanical vibrations. Moreover, in the case where the face 4*b* has a larger surface than that of the face 1*b*, cracks might appear, during the machining, in the zone of the face 4*b* not in contact with the face 1*b*.

A coupling material or means employed for effecting the coupling between the vibratory part 1 and the block 4 is selected as a function of the materials of these two elements and take into account the possible need to separate, after machining, the machined block from the vibratory part without damaging these elements.

When the final use of the machined block allows, it is not essential to separate it from the vibratory part. This is particularly the case when the machined block is intended to be used as an electrode for machining by electro-erosion, the vibratory part 1 then being capable of serving as a support for the electrode. In such a case, the connection between the block and the vibratory part may be made permanent.

However, in most cases, it is desirable to be able to separate the machined block from the vibratory part, if only to enable the re-use of the latter. Also, the coupling between the parts must be effected so as to enable separation without damage, the separation being for example, effected by application of a tensile load or by heating. The coupling material may be an adhesive or a low melting point solder may be used for this purpose.

The adhesive used may, for example, be of the thermal softening type to enable the separation to be effected between the vibratory part and the machined block by the application of tension or by heat to a relatively low temperature. This method of connection is particularly suitable when the block is of a relatively low weight. It has even been found that, for a block of small thickness of light weight, the pressure exerted continuously by the vibratory part on the block during machining is sufficient to hold it in place. Also, in this case, the provision of a connection by use of an adhesive which may be very readily broken has been found to be sufficient.

When the block is of relatively large dimensions, and in order to avoid creation at an inter-face between the vibratory part and the block of a mechanical discontinuity interrupting the propogation of vibrations, coupling will preferably be effected at least in part by brazing or soldering by means of a brazing material or solder of low fusion point, for example a brazing material of an alloy of antimony and indium. In order to effect this brazing, it is necessary in most cases to form first of all a metallic keying or primer base layer, for example a base layer of copper, on the faces to be assembled of the vibratory part and the block. This is the case in particular for a vibratory part of light alloy and a graphite work-piece. The coupling is of the type employing soldering, with metallic diffusion, at least on the atomic scale, of the metallic phase into the graphite and the material of the vibratory part.

By way of example there is described hereafter a method of forming a coupling by brazing between the vibratory part and a graphite block to be machined.

A keying base is formed on the face 1*b* of the vibratory part 1, when the latter is of titanium or of a light alloy, by depositing on this face, possibly pre-treated by sandblasting, a layer of iron of several tenths of a millimeter thickness for example of the order of 0.3 mm by a plasma projection process. A layer of copper of 1 to 2 mm thickness is deposited on this layer of iron by soldering on a copper element or by electroplating.

Similarly a keying base is provided by projection of a thin layer of copper, for example, of several tenths of a micron on the face 4*b* of the block.

The vibratory part is then brought to a temperature of 200° to 250° C, i.e. above the fusion temperature of the brazing or soldering material formed of a tin/lead alloy. The brazing or soldering material is deposited by fusion on the face 1*b* of the hot vibratory part in order to form a film of about 1 mm and the block is offered up, which may be at ambient temperature by causing its face 4*b* to rest on the film of solder. The block 4 drives out by its own weight the excess material and abuts against the face 1b of the vibratory part. If the block 4 is of low weight and small thickness, it may have a tendency to float on the film of brazing material and it is then necessary to apply to the block a force adding to its own weight. The assembly is allowed to cool to ambient temperature, excessively fast cooling being avoided because it is liable to cause cracks in the brazing material.

The blank of the part constituted by the vibratory part 1 and the block 4 is brought into its working position above the tool 5, the front face 4a of the block 4 being disposed opposite the part of the front face 5a of the tool 5 carrying the complementary relief contour of the latter for reproduction on the face 4a of the block 4.

The tool comprises a block which may be of metal or of a ceramic material or of vitrified material. The face 5a of the tool 5 particularly at its part having the complementary relief contour of the latter to be reproduced, is preferably covered with a material resistant to wear, deposited by plasma projection, atomisation or electroplating.

The tool 5 is located on the central part of the bottom of a machining enclosure 6 and is held in place by securing rods 7 screwed to the upper part of the enclosure 6, so that the securing screws lie outside of the zones in which the abrasive is likely to be projected.

The machining is effected by switching on the generator and superposing a rectilinear advancing movement to the vibratory part 1 and the block 4 towards the tool 5 on the rectilinear oscillatory movement of the vibratory part 1. The speed of advance of the block 4 towards the tool 5 may be adjusted as a function of the variations in the area of the working zone between the tool 5 and the block 4 progressively as the front face of the latter is machined. During the whole duration of the machining, abrasive is fed into the space between the tool 5 and the block 4.

This abrasive is supplied through one or more passages 8 which deliver adjacent the lateral vertical surface of the block 4. The abrasive runs along this lateral surface and, guided by the non-active edge of the front face 5a of the tool 5, enters the space between the tool 5 and the block 4. Preferably at least two passages are provided delivering to the two opposite zones of the lateral surface of the block 4 in order to supply the working zone as uniformly as possible.

When the surface of the working zone is relatively large and, particularly, when the relief contour of the tool has at least one projecting part such as 5b, 5c, resulting in a deep penetration of the block 4 into the tool 5, supplementary quantities of the abrasive may be supplied by at least one passage such as the passages 9 communicating, by orifices formed in the wall of the base of the enclosure 6, with channels 10 traversing the tool 5 and delivering to its face 5a at the level of the said projecting parts. The quantities and pressure of the abrasive material supplied by the channels 10 must however be kept within limits in order to avoid creation of a high resistance to the forces exerted on the vibratory part.

This feature enables the supply of abrasive in zones which would not readily be accessible to the abrasive supplied by the passages 9 and thereby to obtain a uniform distribution of the abrasive in the working zone. It will be noted that this feature could not readily be provided in the case where ultrasonic machining is effected by means of a movable tool, the work-piece being fixed, because the channels could not be formed in the work-piece which would be difficult taking into account the difficulties of machining and undesirable in view of the future use of the machined part. If these channels were formed in the vibratory part the tool might cause loss of power in the mechanical vibrations transmitted.

The abrasive is selected as a function of the material to be machined and consists for example of alumina, corundum, silicon carbide or boron carbide. This abrasive is used in a particle form of which the coarseness lies between, for example, 280 and 600, that is a size of several microns, these particles being carried by a liquid vehicle such as water or petroleum. The abrasive liquid mixture contains about 1 Kg of abrasive to 5 to 10 liters of liquid.

The liquid, the abrasive and the particles of material machined away are evacuated through an opening 11 situated in the base of the enclosure 6 and are collected in a recycling assembly 12.

This recycling assembly 12 comprises a decanting vessel 13 in which the particles of material machined are separated. Thus, when the latter is graphite which would, if it were recycled reduce the cutting power of the abrasive, a mass of graphite is collected on the surface of the liquid in the decantation vessel 13 and is removed therefrom. The liquid and the abrasive are then conducted into a recycling vessel 14 where they are intimately mixed by means of an agitator 15. The mixture is removed from the lower part of the recycling vessel 15, by means of a pump 16 in order to be recycled through the passages 8 and 9.

Means 17 for controlling the flow are mounted on the pipes 8 and 9. The pipes 8 and 9 may be of a plastics material and the control members 17 may be simple pinching devices controlled by a screw in order to change the effective cross-section of the passage of the pipes. The control of flow is effected as a function of the speed of advance of the block to be machined 4, of the nature of the abrasive, of the material to be machined and so on. Preferably, for a given speed of advance, the supply of liquid abrasive mixture is kept constant.

The consumption of abrasive is low and the latter is cleaned and renewed periodically after one or more machining operations.

When the duration of the machining operation is relatively long, it may be desirable to effect a periodic cleaning of the assembly of the vibrator part and the block to be machined in order to enable spraying of the face 5a of the tool 5 with a mixture of the liquid abrasive supplied through the pipes 8 and thus to renew this mixture completely in the working zone.

The ultrasonic machining is effected with maximum efficiency when the lower end of the assembly of the vibratory part and the block 4 is located at an antinode of the oscillations generated in this assembly. Because the volume of this assembly decreases during the machining operation, the useful power transmitted reduces to an extent where the frequency of the vibrations being fixed, the lower end of the assembly of the vibratory part and the block 4 becomes spaced from the location of the antinode of the vibrations.

When the block to be machined is machined to a relatively shallow depth, for example of the order of 1 to 3 mm, this loss of power is very limited, the variation in the length of the block 4 remaining negligible with respect to the wavelength of the oscillations.

When the machining must be carried out to a relatively large depth, it is desirable, in order not to affect the efficiency, to cause the frequency of the signals emitted by the generator 3 to be changed progressively with the reduction in the volume of the block to be machined. This matching of the generator 3 can be effected manually or automatically as a function of the amplitude of the advance imparted to the assembly of the vibratory part and the block 4.

At the end of the machining operation, the machined block is finally separated from the vibratory part, as indicated above. The block 4 may be machined on one part, for example, centrally, on the front fact 4a or with the aid of precise location of the block 4 and the tool 5, over the whole or a predetermined zone on the front face 4a.

Figure 2:
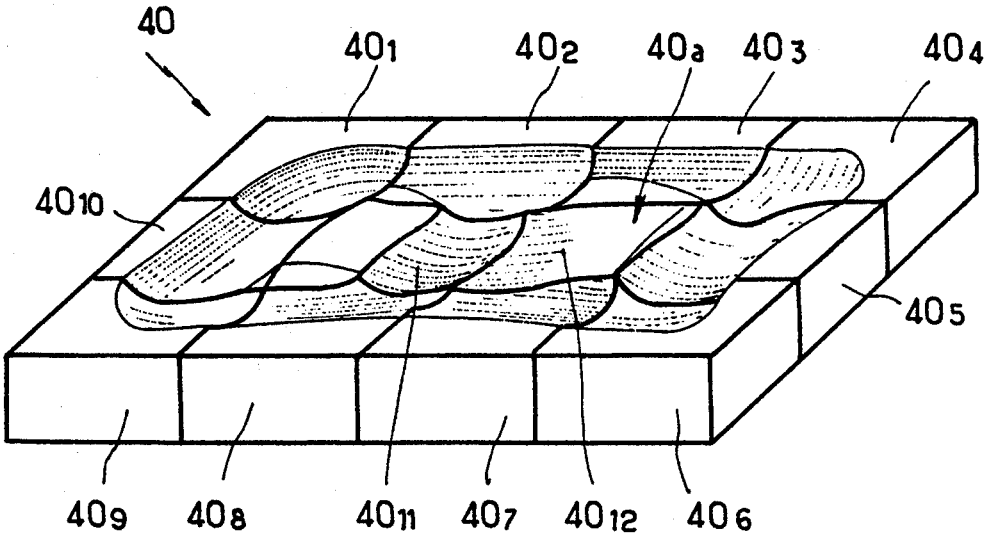
FIG. 2 is a part manufactured by a modular ultrasonic frequency machining method in accordance with the invention.

The latter feature enables the manufacturer of parts of large dimensions such as the part 40 illustrated in FIG. 2. In order to carry this out the blocks $40_1$, $40_2$, and $40_{12}$ are machined separately which, after machining, are preferably identical standard blocks of which the front surface may have an area for example of the order of 25 $cm^2$. On one face of each of these blocks there is reproduced by the method such as described hereinbefore, a part of the relief contours of the front face 40a of the part 40.

Each block is machined by means of a corresponding tool, the block and the tool being located relatively to one another with precision so as to reproduce the complementary relief contour of the latter of the tool on the whole or on a predetermined zone of the front face of the block.

The machined blocks are then assembled, for example, by application of adhesive to their lateral faces, the assembly of their front machined faces constituting the desired relief contour for the whole of the part 40.

I claim:

1. In an ultrasonic machining installation for producing a relief contour on a work-piece by means of a tool, an improvement comprising:

means defining a machining enclosure;

means for securing said tool on the bottom of said enclosure;

a support for said work-piece above the bottom of said enclosure;

means for imposing ultrasonic frequency vibrations on said work-piece comprising:

an electrical ultrasonic frequency vibration generator;

a vibratory part coupled to said generator; and a transducer for converting electrical oscillations into mechanical vibrations;

means for driving said work-piece vertically above the bottom of said enclosure;

means defining at least one passage for supplying an abrasive in a liquid vehicle, this passage delivering to the interior of the machining enclosure and being capable of supplying the abrasive/liquid mixture at a level above that of the upper face of said tool; and a recycling assembly for recycling the abrasive/liquid mixture connected to an orifice situated in the bottom of said machining enclosure.

2. An installation according to claim 1, comprising means defining at least one second passage for the supply of the abrasive/liquid mixture communicating with an orifice which is formed in the wall of the bottom of the machining enclosure and which is capable of communicating with channels formed in the tool.

3. A method of ultrasonic machining a work-piece by means of a tool having one face with a relief contour complementary to the relief contour to be reproduced on a face of the work-piece, said method comprising the steps of:

securing the work-piece to the lower end portion of a vertically extending elongated vibratory part by brazing by means of a brazing material having a low melting point interposed between an upper face of the work-piece opposite the face to be machined and a lower face of the vibratory part, whereby the work-piece can be separated from the vibratory part by heating of the brazing material;

coupling the vibratory part to a transducer for converting electrical oscillations into mechanical vibrations;

securing the tool to a fixed support located beneath the vibratory part with said face of the tool facing the face of the work-piece to be machined;

machining the face of the work-piece on which the relief contour is to be reproduced by lowering the work-piece onto said tool and applying mechanical vibrations to the vibratory part, the latter transmitting said mechanical vibrations to the work-piece; and supplying abrasive material to the space between the opposed faces of the tool and the work-piece.

4. The method recited in claim 3 and comprising the further step of depositing a metal keying base for the brazing material on the surfaces to be secured together of the vibratory part and the part to be machined.

5. The method recited in claim 3 and comprising the further step of supplying abrasive material to the space between the opposed faces of the tool and the work-piece through at least one channel provided through the tool.

6. The method recited in claim 3 and comprising the further step of modifying the frequency of oscillations during the machining operation in order to take into account the variation in volume of the assembly constituted by the vibratory part and the work-piece.

7. A method of forming a machined surface comprising the steps of:

providing several standard work-pieces in the form of blocks;

machining each of said work-pieces by means of a tool having one face with a relief contour complementary to the relief contour to be reproduced on a face of said work-piece, each of said blocks being machined by an ultrasonic machining method comprising the steps of:

securing the work piece to the lower end portion of a vertically extending elongated vibratory part by brazing by means of a brazing material having a low melting point interposed between an upper face of the work-piece opposite the piece to be machined and a lower face of the vibratory part, whereby the work-piece can be separated from the vibratory part by heating of the brazing material;

coupling the vibratory part to a transducer to converting electrical oscillations into mechanical vibrations;

securing the tool to a fixed support located beneath the vibratory part with said face of the tool facing the face of the work-piece to be machined;

machining the face of the work-piece on which the relief contour is to be reproduced by lowering the work-piece onto said tool and applying mechanical vibration to the vibratory part, the latter transmitting said mechanical vibrations to the work-piece; and supplying abrasive material to the space between the opposed faces of the tool and the work-piece; and juxtaposing and assembling the machined work-pieces so as to obtain a piece having one composite face with a relief contour constituted by the juxtaposed machined faces of said work-pieces.

8. An assembly for ultrasonic machining of a work-piece, said assembly comprising:

a tool having an upper face with a relief contour complementary to that to be reproduced on a first face of said work-piece;

an elongated vibratory part;

a transducer for converting electrical oscillations into mechanical vibrations, said vibratory part having one and portion adapted for connection to said transducer to thereby transmit the mechanical vibrations to said vibratory part;

a brazing material securing the face of said work-piece opposite to its said first face to a lower end portion of said vibratory part, said brazing material having a low melting point whereby the work-piece can be separated from the vibratory part by heating of the brazing material; and means for supplying an abrasive in a liquid vehicle, including means for forcing the liquid abrasive mixture through at least one channel formed in the tool and opening in the upper face thereof.

* * * * *

UNITED STATES PATENT AND TRADEMARK OFFICE

CERTIFICATE OF CORRECTION

PATENT NO. : 4,100,701

DATED : July 18, 1978

INVENTOR(S) : Louis Pierre Bessaguet

It is certified that error appears in the above-identified patent and that said Letters Patent are hereby corrected as shown below:

Column 1, line 60, "to" should read --at--.
Column 3, line 43, "include lc" should read --include portions lc--.
Column 7, line 11, "fact" should read --face--.
Column 8, line 61, "to" should read --for--.
Column 10, line 4, "and" should read --end--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*